United States Patent [19]

Sheffield et al.

[11] 3,982,242

[45] Sept. 21, 1976

[54] McCULLOH RECEIVER

[75] Inventors: Herman E. Sheffield, Houston, Tex.; Paul D. Welshans, Pedley, Calif.

[73] Assignee: Honeywell Inc., Minneapolis, Minn.

[22] Filed: Sept. 23, 1975

[21] Appl. No.: 616,116

[52] U.S. Cl. ..... 340/409; 340/292

[51] Int. Cl.[2] ..... G08B 24/00

[58] Field of Search ..... 340/409, 276, 227, 248 A, 340/248 E, 248 R, 292

[56] References Cited

UNITED STATES PATENTS

| | | | |
|---|---|---|---|
| 3,587,082 | 6/1971 | Muehter | 340/409 X |
| 3,641,547 | 2/1972 | Reiss | 340/409 X |
| 3,662,383 | 5/1972 | Ajmani | 340/409 |
| 3,668,701 | 6/1972 | Mayberry | 340/409 |
| 3,697,984 | 10/1972 | Atkinson | 340/409 X |

*Primary Examiner*—Harold I. Pitts
*Attorney, Agent, or Firm*—Trevor B. Joike

[57] ABSTRACT

A receiver is disclosed connected to a McCulloh loop, having an N or line side and a G or ground side, for receiving coded alarm signals from a plurality of McCulloh transmitters. The receiver is especially adapted for supplying the alarm signals to a computer and has N and G process logic circuits to ensure that the polarity of the output signals supplied to the computer from the logic circuits remains the same regardless of the polarity of input signals supplied to the logic circuits. The receiver also has an inhibit circuit to prevent the G process logic circuit from supplying its output to the computer except upon the occurrence of a fault condition in the McCulloh loop, a fault sensing circuit for sensing a fault in the McCulloh loop and for connecting the ground side of the loop and the line side of the loop together and a sampling circuit for testing the McCulloh loop during a fault condition to resume normal operation in the loop upon the clearance of the fault.

24 Claims, 8 Drawing Figures

McCULLOH RECEIVER

BACKGROUND OF THE INVENTION

The invention relates to a McCulloh receiver for processing coded alarm signals on a McCulloh loop and is especially arranged for supplying these coded alarm signals to a computer for processing.

As the crime rate has historically been increasing, it has been necessary for business establishments to provide a security system to guard against the possibility of a burglary occurring during non-business hours or a hold-up occurring during business hours. Large business establishments can well afford to have their own internal security force for patrolling those establishments to uncover or prevent security problems. However, smaller business establishments cannot afford to provide their own internal security force in the form of guards for patrolling their premises; therefore, to meet their needs, central station burglar alarm operations have been established to provide a security service to these smaller concerns.

This central station typically has a plurality of alarm indicators each connected over a leased telephone line to a corresponding subscriber. A subscriber may have a single line dedicated to himself only (direct wire) or he may share a party line (McCulloh loop). The subscriber has on his premises an alarm transmitter for transmitting an alarm signal over the telephone line to the alarm indicators at the central stations.

A typical McCulloh loop comprises a line side and a ground side connected to either side of a battery such that line current normally flows in the loop. A transmitter sends its coded alarm to the central station by opening and grounding the loop.

Each subscriber on a McCulloh loop has a McCulloh transmitter for transmitting a message of a code which particularly identifies his specific premises. The coded message from a particular subscriber can identify the type of alarm, e.g. burglary, fire or the line, as well as the subscriber sending the alarm.

A more expensive form of transmitting an alarm signal to the central station is the direct wire system. In a direct wire system, a single leased line is dedicated to a single subscriber. The central station then monitors the current level on the direct wire to determine whether an alarm condition exists at the remote premises.

One of the functions of the operator at the central station is to monitor his alarm indicators to determine whether an alarm condition exists at a remote premises when an alarm signal has been received. His first function, upon receiving an alarm signal, is to see if that alarm signal represents an opening or closing of the premises according to an opening and closing schedule. If the alarm signal is received at 9 o'clock in the morning and the event schedule indicates that the owner usually opens his business establishment at 9 o'clock in the morning, the alarm signal is noted but no further action is taken. However, if the alarm signal is received at 7 o'clock in the morning, the central station then dispatches a security guard or police to that remote establishment.

Since there may be many hundred subscribers to a central station service, the number of alarms occurring during a normal opening time or closing time can be substantial so that several operators have to be employed to monitor these signals. By computerizing the central station, e.g. according to the Witt el al. application Ser. No. 390,232 filed Aug. 21, 1973, most of these operators can be eliminated and the computer can then perform the function of monitoring the alarm signals and comparing them to an event schedule to determine whether an alarm situation exists. If an alarm situation exists, the computer prints out to the operator or otherwise displays to the operator the procedure to be followed which may be to first contact the remote subscriber to determine whether the owner has violated his own event schedule, to then call the owner at home and then to contact the police or security force. Since a computer is used to process the signals received from the remote premises, the signals transmitted by the receivers in the central station to the computer must be of a form which allows the computer to process them.

SUMMARY OF THE INVENTION

The McCulloh receiver according to the instant invention has a process circuit for the line side of the McCulloh loop and a process circuit for the ground side of the McCulloh loop to provide an output to the computer having a single polarity regardless of the polarity of the coded signals on the McCulloh loop. Since the coded signals on the line side of the McCulloh loop are typically of a better quality than the signals on the ground side of that loop, priority is given to the process logic connected to the line side of the McCulloh loop by inhibiting the ground side process logic during normal operation of the McCulloh loop but not inhibiting that logic when a fault condition has occured on the McCulloh loop.

A fault sensing circuit is included to sense the various fault conditions which may exist on a McCulloh loop. For example, the McCulloh loop may be grounded or open at any point therealong, it may be open on the line side and grounded on the ground side, or it may be grounded on the line side and open on the ground side. The fault sensing circuit senses these conditions and, upon the occurrence of a fault condition, connects the ground side of the loop to the terminal of the battery to which the line side is connected to ensure that any alarm signals occurring on either side of the fault condition will be received and processed by the alarm receiver. A sampling circuit is also included to sample the McCulloh loop during a fault condition to determine whether or not the fault condition has been cleared. If it has been cleared, the sampling circuit then disconnects the ground side of the loop from the line side and restores normal operation of the McCulloh loop.

These and other advantages will become apparent when receiving the detailed description of the invention in connection with the drawings in which:

BRIEF DESCRIPTION OF THE DRAWINGS

FIG. 2A shows in detail the current limiter and ground side to line side switch;

FIG. 2B shows in detail the N process logic;

FIG. 2C shows in detail the G process logic;

FIG. 2D shows in detail the inhibit circuit;

FIG. 2E shows in detail the fault sensing circuit;

FIG. 2F shows in detail the sampling circuit; and,

DETAILED DESCRIPTION OF THE INVENTION

Figure 1:
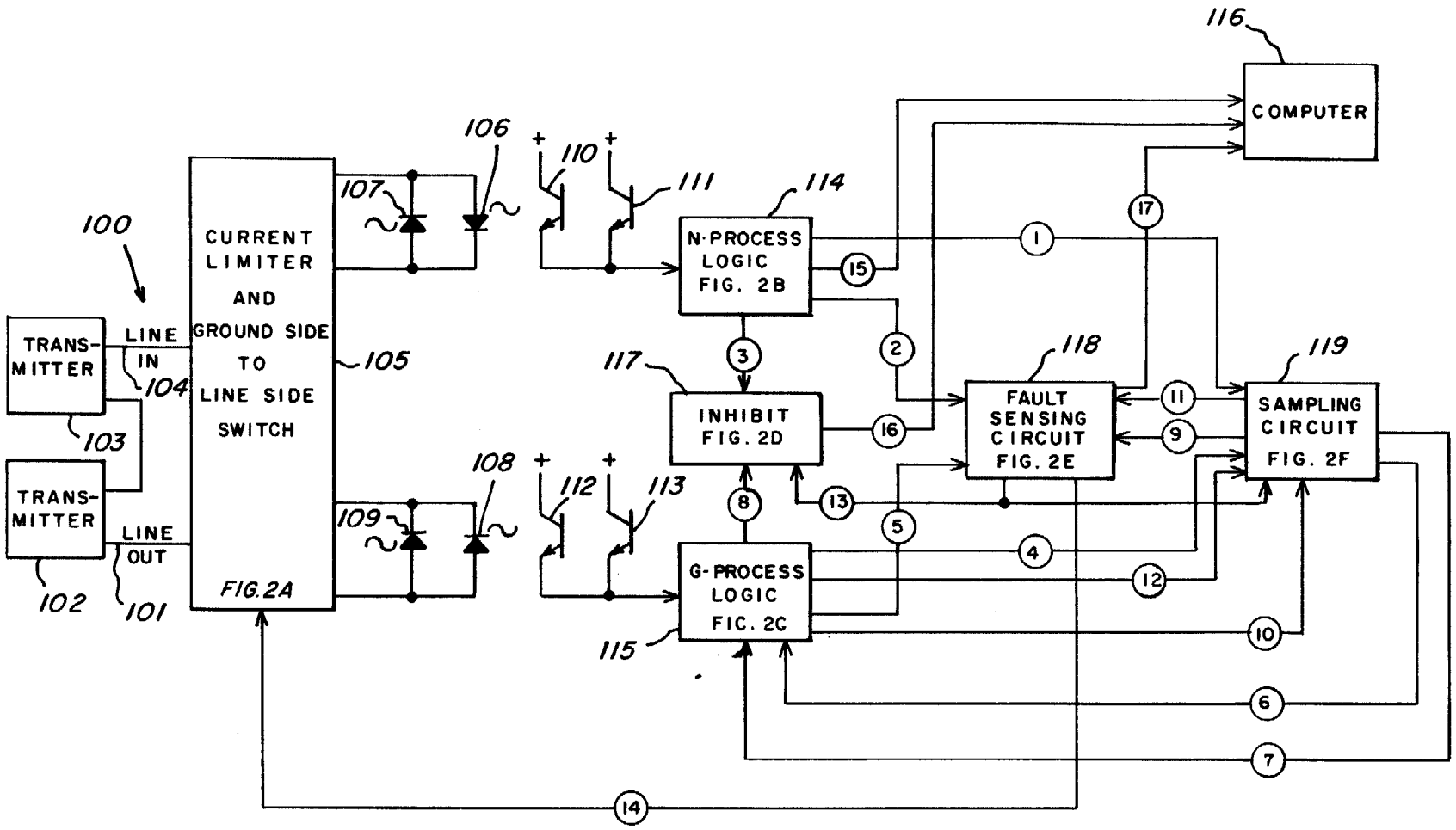
FIG. 1 shows a block diagram of the system and how

In FIG. 1, McCulloh loop 100 has a line out side 101 which is connected to one terminal of a battery in current limiter and ground to line side switch circuit 105 and is connected to transmitter 102 which is in turn connected to transmitter 103. Transmitter 103 is connected by line in side 104 of the McCulloh loop back to the other and grounded terminal of the battery in current limiter and ground side to line side switch 105. On the McCulloh loop, there are typically several hundred transmitters so that the showing of only two transmitters 102 and 103 in FIG. 1 is for purposes of explanation only. Current limiter and ground side to line side switch 102 performs a number of functions. First, it limits the current on the McCulloh loop and has an arrangement adjusting current level in that loop. It also functions, during a fault condition on the McCulloh loop, to connect line in side 104 from ground to the other terminal of the battery to which line out side 101 is connected.

Upon the occurrence of an alarm condition at the premises which is supervised by either transmitters 102 or 103, the coded signal is sent to the current limiter and grounded side to line side switch circuit 105 which then supplies these signals to the light emitting diode sets 106–107 and 108–109. Diode 106 is associated with a photo responsive transistor 110 and diode 107 is associated with a photo responsive transistor 111. Diode 108 is associated with photo responsive transistor 112 and diode 109 is associated with photo responsive transistor 113. Thus, the coded signals are supplied through the optical isolating circuits to N process logic circuit 114 and G process logic circuit 115.

The N process logic circuit 114 ensures that the output supplied at terminal 15 to computer 116 will have the same polarity regardless of the polarity of the input signal on the line out side of the McCulloh loop and the G process logic circuit 115 ensures that its output which is supplied through the inhibit circuit to terminal 16 is of the same polarity regardless of the input signal on the ground side or line in side 104. Inhibit circuit 117 may be considered part of G process logic 115 except that it is shown as a separate block since it performs the additional inhibit function. The output from G process logic circuit 115 is supplied at terminal 8 to the input to the inhibit circuit and then to terminal 16 to computer 116.

Since the signal which is transmitted over the ground side of the McCulloh loop is typically not as clear as the signal transmitted over the line side of the McCulloh loop, inhibit circuit 117 ensures that, under normal loop conditions, only the line out side signal is supplied by N process logic circuit 114 to the computer and that the signal from G process logic circuit 115 is inhibited.

Thus, under normal operating conditions of the McCulloh loop, the McCulloh signal transmitted over the ground side of the loop and supplied to inhibit circuit 117 and terminal 8 is inhibited from being supplied to terminal 16. However, if a fault condition occurs such that the McCulloh signal is transmitted only over the ground side of the loop, inhibit circuit 117 does not receive an input, at terminal 3, from N processs logic circuit 114 and the McCulloh signal is then transferred to terminal 16 and to computer 116.

Fault sensing circuit 118 and sampling circuit 119 can be considered to be the same circuit except that they are shown as separate blocks to identify their specific functions. These circuits receive inputs from N process logic circuit 114 and G process logic circuit 115 to sense the occurrence of a fault condition on the loop 101–104. If a fault condition does occur, fault sensing circuit 118 supplies an output to terminal 14 and then to current limiter and ground side to line side switch 105 to connect line 104 to the other side of the battery. Sampling circuit 119 then samples the McCulloh loop by periodically reconnecting the line 104 to the ground side of the battery to test if the fault condition still exists. If the fault condition does still exist, the sampling circuit 119 will continue its periodic sampling. If the fault condition has been cleared, the reconnection of line 104 to the ground side of the battery is maintained and the system will then perform normally.

The terminals 1–17 shown in FIG. 1 are also used in FIGS. 2A–2F to show how these detailed circuit diagrams of the blocks of FIG. 1 are connected together.

Figure 2A:
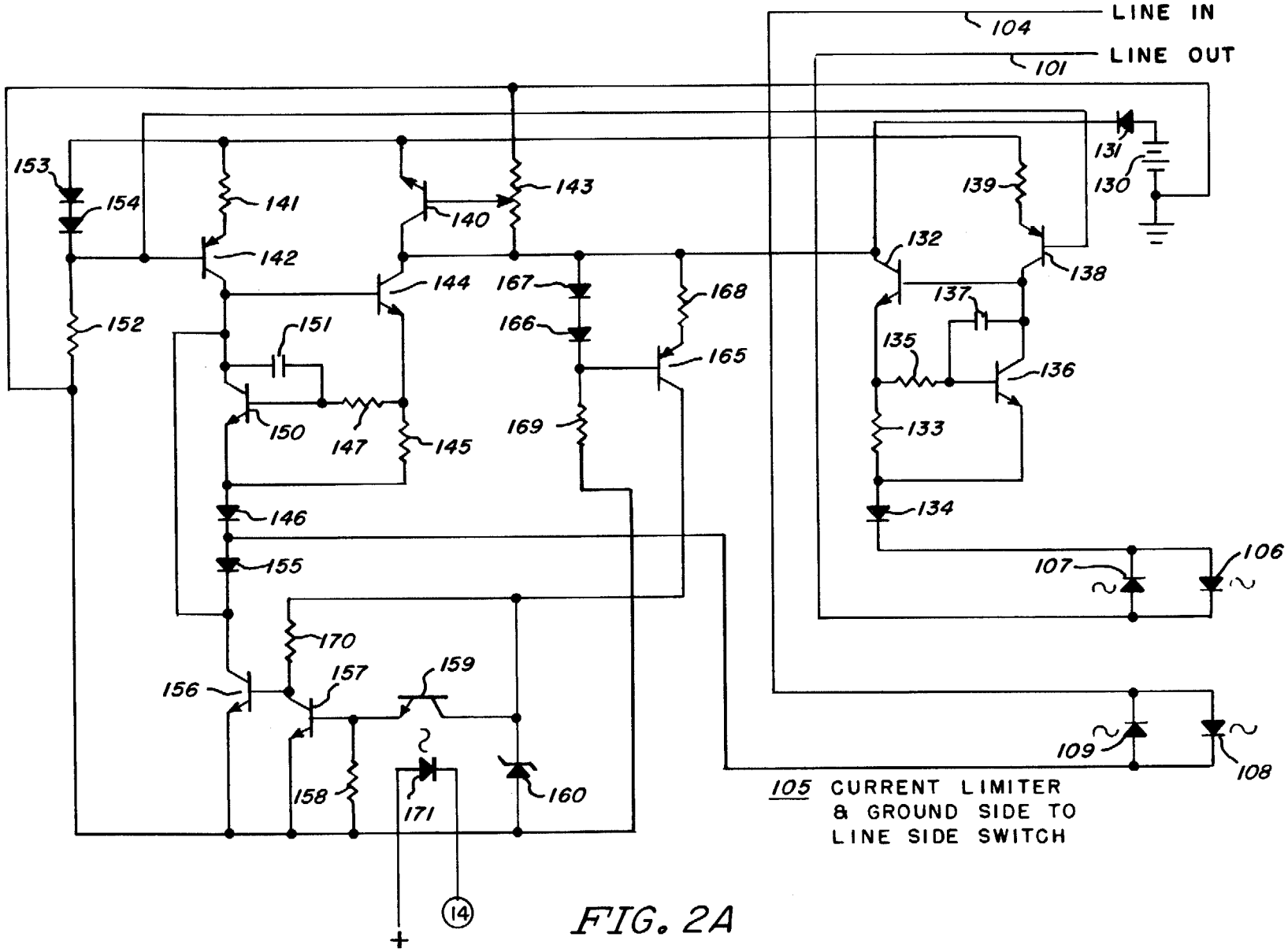
FIGS. 2A–2F are connected together.

FIG. 2A shows the details of the current limiter and ground side to line side switch circuit. Battery 130 is connected through diode 131 to the collector terminal of transmitter 132. The emitter terminal of transistor 132 is connected through resistor 133 and diode 134 to diode pair 106-107 the other side of which is connected to line out side 101 of the McCulloh loop. The emitter of transistor 132 is also connected through resistor 135 to the base of transistor 136 the collector of which is connected back to its base through capacitor 137. The emitter of transistor 136 is connected to the junction of resistor 133 and diode 134. The base of transistor 132 is connected to the collector of transistor 136 and to the collector of transistor 138 the emitter of which is connected through resistor 139 to the emitter of transistor 140.

The emitter of transistor 140 is also connected through resistor 141 to the emitter of transistor 142. The base of transistor 140 is connected to current level adjustment potentiometer 143 which is connected from the positive terminal of battery 130 through diode 131 and back to the grounded side of battery 130. The potentiometer 143 and the collector of transistor 140 are connected together and to the collector of transistor 144 the emitter of which is connected through resistor 145 and diode 146 to light emitting diode pair 108–109 the other side of which is connected to line in side 104 of the McCulloh loop. The junction of the emitter of transistor 144 and resistor 145 is connected through resistor 147 to the base of transistor 150 the emitter of which is connected to the junction of resistor 145 and diode 146. The collector of transistor 150 is connected back through capacitor 151 to its base and is also connected to the base of transistor 144 and to the collector of transistor 142. The base of transistor 142 is connected to the base of transistor 138 and also through resistor 152 to the grounded side of batery 130. The junction of resistor 141 and the emitter of 140 is connected through diodes 153 and 154 to the base of transistor 142. The junction of diode 146 and diode pair 108–109 is connected through diode 155 to the collector of transistor 156 the emitter of which is connected to the negative or ground terminal of battery 130.

The base of transistor 156 is connected to the collector of transistor 157 the emitter terminal of which is connected to the grounded side of battery 130. The base of transistor 157 is connected both to the negative or ground terminal of battery 130 through resistance 158 and to the emitter terminal of photo responsive transistor 159 the collector of which is connected through zener diode 160 to the grounded terminal of battery 130.

The junction of the collector of transistor 140, the collector of transistor 144 and potentiometer 143 is connected both to the base of transistor 165 through diodes 166 and 167 and to the emitter of transistor 165 through resistance 168. The junction of the diode 166 and the base of transistor 165 is connected through resistance 169 to the negative terminal of battery 130. The collector of transistor 165 is connected both to the junction of the photo responsive transistor 159 and zener diode 160 and to the collector of transistor 157 through resistor 170.

The photo transistor 159 is responsive to light emitting diode 171 which has one terminal connected to a positive source and the other terminal connected to terminal 14.

This circuit performs the function of limiting the current in the McCulloh loop comprising lines 101 and 104 and potentiometer 143 may be adjusted to establish the current level in the McCulloh loop.

Figure 2B:
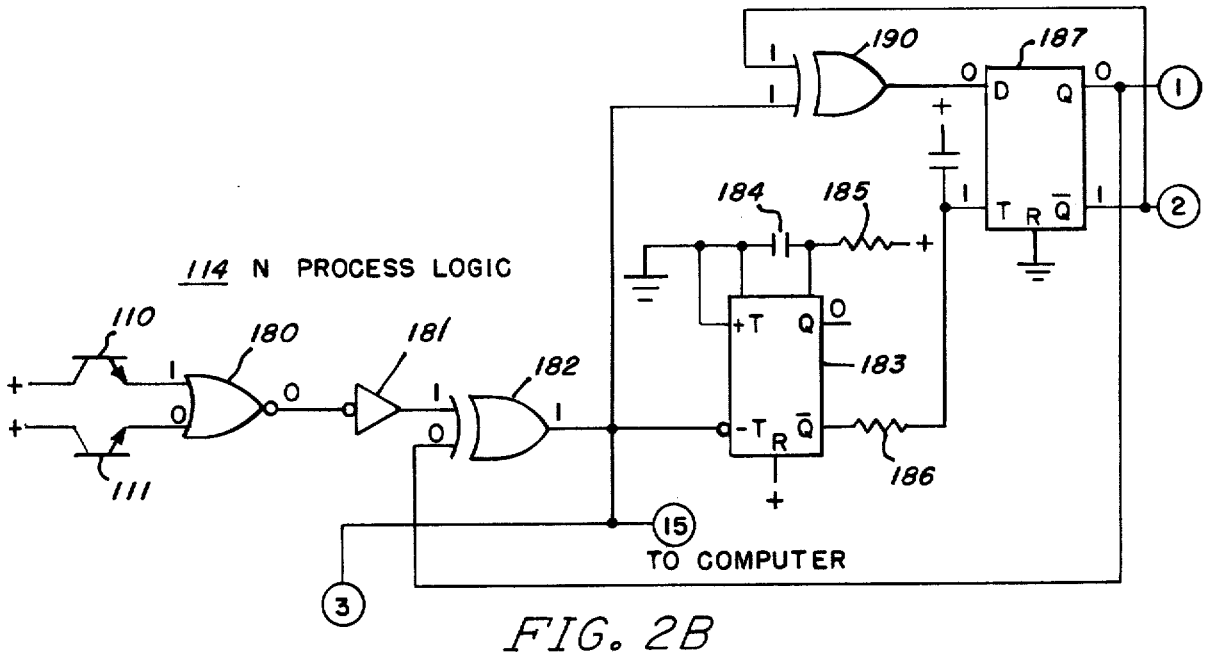

The N process logic circuit 114 is shown in detail in FIG. 2B. The collectors of transistors 110 and 111 are connected to a positive source and the emitters are connected to the inputs of a NOR circuit 180 the output terminal of which is connected through inverter 181 to one input of EXCLUSIVE OR 182. The output from EXCLUSIVE OR 182 is connected to terminals 3 and 15 and to the −T terminal of multivibrator 183. The +T terminal of 183 is connected to ground and to one side of capacitor 184 the other side of which is connected to a positive source through resistor 185. Circuit 183 together with resistor 185 and capacitor 184 form a one shot monostable multivibrator having a pulse duration when it is triggered of approximately 3 seconds. The $\bar{Q}$ terminal of multivibrator 183 is connected through resistor 186 to the T terminal of D flip-flop 187. The output from EXCLUSIVE OR 182 is also connected to one input of EXCLUSIVE OR 190 the output of which is connected to the D terminal of flip-flop 187. The Q terminal of the flip-flop 187 is connected to terminal 1 and to the other input of EXCLUSIVE OR 182 and the $\bar{Q}$ terminal of flip-flop 187 is connected to terminal 2 and to the other input of EXCLUSIVE OR 190. The reset terminal of flip-flop 187 is grounded.

Figure 2C:
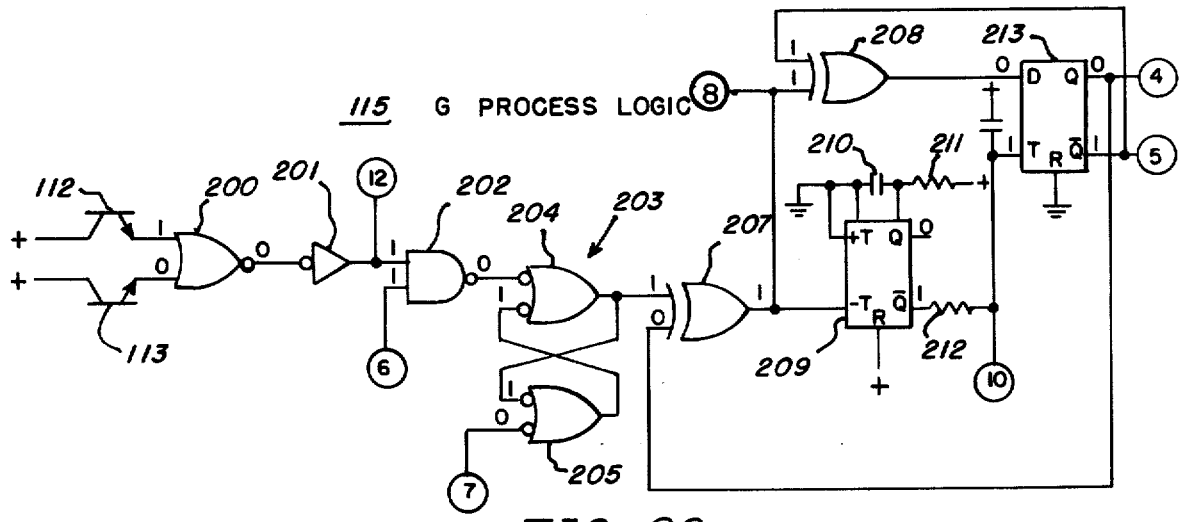

The G process logic circuit 115 is shown in FIG. 2C. Photo responsive transistors 112 and 113 have their collectors connected to a positive source and their emitters connected to the inputs of NOR circuit 200 the output of which is connected through inverter 201. The output of inverter 201 is connected to terminal 12 and to one input of NAND 202 the other input of which is connected to terminal 6. The output of NAND 202 is connected to one input terminal of ground storage latch 203 the other input terminal of which is connected to terminal 7. The ground storage latch comprises a first noted input OR 204 having one input from NAND 202 and a second input from the output of notted input OR 205. The first input of the circuit 205 is connected to the output of OR 204 and the other input is connected to terminal 7. The output from latch 204 is connected to one input terminal of EXCLUSIVE OR 207 which has its output connected to terminal 8, to one input of EXCLUSIVE OR 208 to the −T terminal of multivibrator 209. The +T terminal of 209 is connected to ground and to one side of capacitor 210 the other side of which is connected to a positive source through resistor 211 to form a one shot monostable multivibrator having an output pulse of an approximate 3 second duration. The $\bar{Q}$ output terminal of multivibration 209 is connected through resistor 212 to terminal 10 and to the T terminal of D flip-flop 213. The EXCLUSIVE OR 208 has its output connected to the D terminal of flip-flop 213. The Q output of 213 is connected to terminal 4 and to the other input of EXCLUSIVE OR 207 and the $\bar{Q}$ terminal of flip-flop 213 is connected to terminal 5 and to the other input terminal of EXCLUSIVE OR 208. The reset terminal of flip-flop 213 is connected to ground.

Figure 2D:
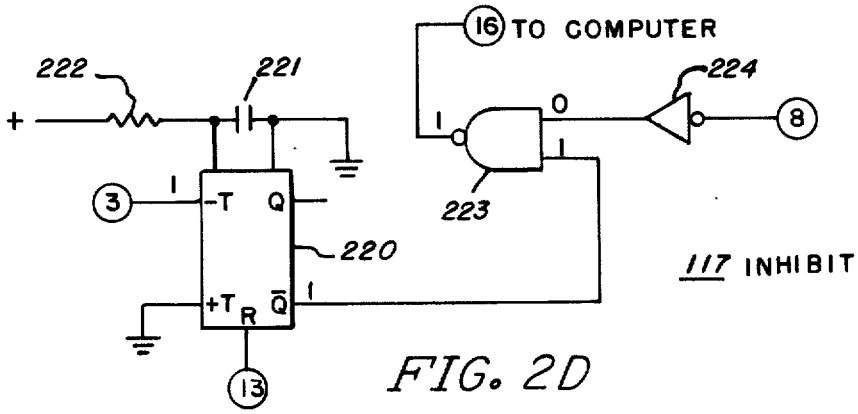

Inhibit circuit 117 is shown in detail in FIG. 2D. It comprises multivibrator 220 which has its +T terminal connected to ground and its −T terminal connected to terminal 3. Multivibrator 220 is connected to capacitor 221 which has one side connected to ground and the other side connected to a positive source through resistor 222. The $\bar{Q}$ terminal of multivibrator 220 is connected to one input of NAND gate 223 the other input of which is connected from inverter 224 and terminal 8. The output of NAND 223 is connected to terminal 16 and the reset terminal of multivibrator 220 is connected to terminal 13. Multivibrator 220 is arranged as a one shot monostable multivibrator for providing an output pulse of approximately 3 seconds.

Figure 2E:
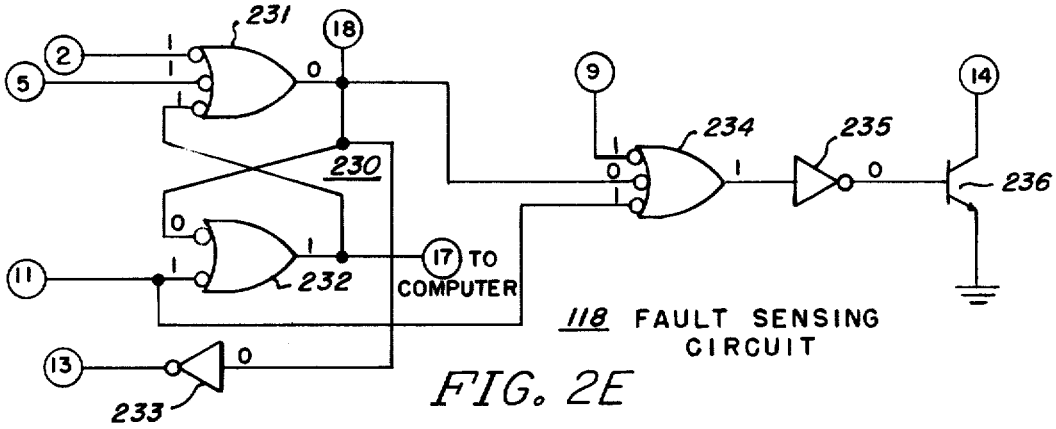

Fault sensing circuit 118 is shown in FIG. 2E and comprises fault latch circuit 230 having notted input OR 231 having a first input connected to terminal 2, a second input connected to terminal 5 and a third input terminal connected from the output of notted input OR 232. One input of gate 232 is from the output of gate 231 and the other input of gate 232 is connected to terminal 11. The output of gate 231 is connected to terminal 18 and to terminal 13 through inverter 233 and to one input of notted input OR 234 which has a second input connected to terminal 9 and a third input connected to terminal 11. The output from gate 232 is connected to terminal 17. The output of gate 234 is connected through inverter 235 to the base of transistor 236 which has its collector connected to terminal 14 and its emitter connected to ground.

Figure 2F:
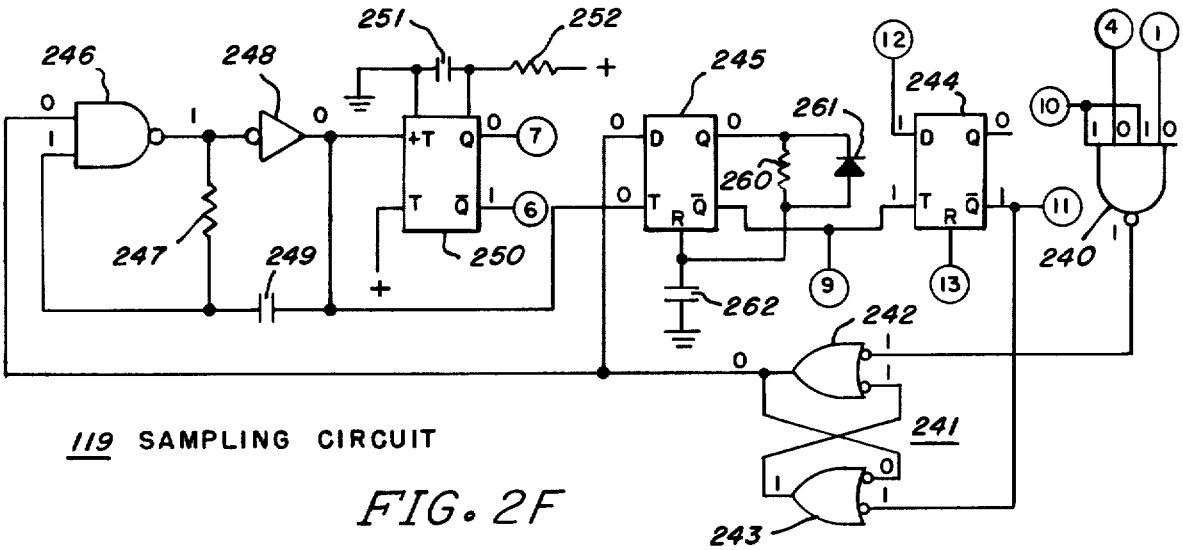

Sampling circuit 119 is shown in detail in FIG. 2F and comprises NAND 240 having inputs connected to terminals 1, 4 and 10 and an output connected to one input terminal of oscillator enable gate 241. The oscillator enable gate 241 comprises notted input OR gate 242 having one input from NAND gate 240 and another input from notted input OR gate 243. Gate 243 has one input terminal from the output of gate 242 and a second input from the $\bar{Q}$ terminal of D flip-flop 244. The output gate 241 is connected both to the D terminal of D flip-flop 245 and to one input of NAND gate 246. The output of NAND gate 246 is connected through resistor 247 to the other input terminal of NAND gate 246 and to inverter 248. The output of the inverter is connected through capacitor 249 to the junction of resistor 247 and the second input of NAND gate 246 and to the +T terminal of multivibrator 250. The −T terminal of multivibrator 250 is connected to a positive source and multivibrator 250 is connected to a capacitor 251 having one side connected to ground and the other side connected to a positive source through resistor 252. The Q terminal of multivibrator 250 is connected to terminal 7 and the $\bar{Q}$ terminal is connected to terminal 6. NAND gate 246, inverter 248, resistor 247 and capacitor 249 form an oscillator having an approximately 10 second period or 0.1 hertz frequency. Multivibrator 250 forms a one shot monostable multi-vibrator having an output pulse of an approximately 140 millisecond duration. The output from the oscillator is also connected to the T terminal of flip-flop 245 the D terminal of which is connected to the output of the oscillator enable gate 241. The Q terminal of flip-flop 245 is connected through the parallel combination of resistor 260 and diode 261 to the junction of the reset terminal of flip-flop 245 and capacitor 262 the other side of which is connected to ground. The $\overline{Q}$ terminal of flip-flop 245 is connected to terminal 9 and to the T terminal of D flip-flop 244 the D terminal of which is connected to terminal 12. The $\overline{Q}$ of flip-flop 244 is connected to the oscillator enable gate circuit 241 and to terminal 11 and the reset terminal of flip-flop 244 is connected to terminal 13.

Figure 3:
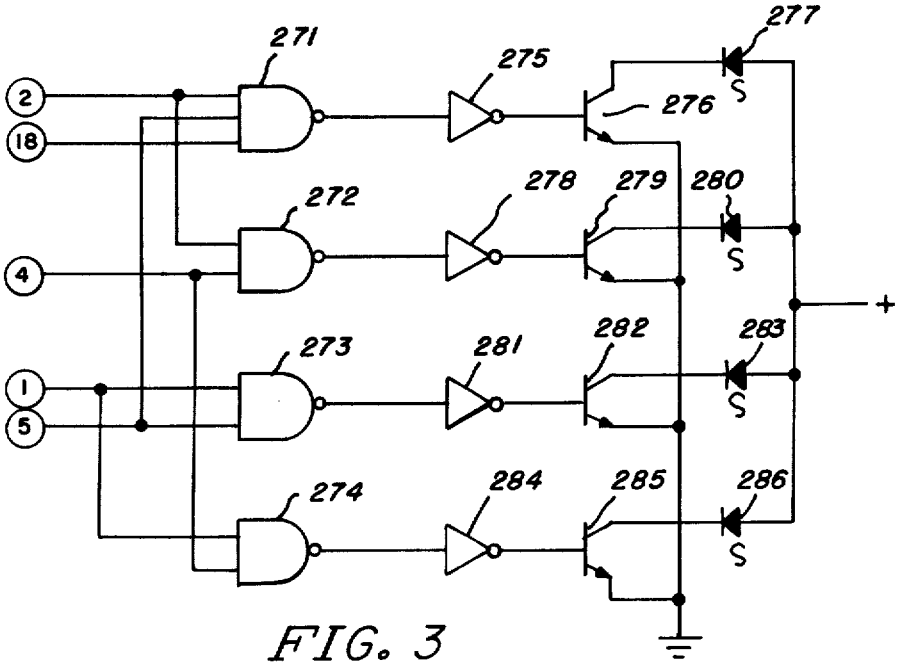
FIG. 3 shows a circuit which may be arranged for indicating the particular type of fault occurrence.

The circuit shown in FIG. 3 is one form of a circuit which can be used for displaying the various fault conditions that may exist in a McCulloh loop which include an open condition, a ground condition, an open-ground condition and a ground-open condition. The indicator comprises NAND 271 which has a first input connected to terminal 2, a second input connected to terminal 18 and a third input connected to terminal 5. NAND 272 has an input connected to terminal 2 and an input connected to terminal 4. NAND gate 273 has an input connected to terminal 1 and an input connected to terminal 5 and NAND gate 274 has an input connected to terminal 1 and an input connected to terminal 4. The output of NAND gate 271 is connected through inverter 275 to the base of transistor 276 the collector of which is connected through light emitting diode 277 to a positive source and the emitter of which is connected to ground. The output of NAND gate 272 is connected through inverter 278 to the base of transistor 279 which has its collector terminal connected through light emitting diode 280 to the positive source and its emitter connected to ground. The output of NAND gate 273 is connected through inverter 281 to the base of transistor 282 the collector of which is connected through light emiting diode 283 to the positve source and the emitter of which is connected to ground. The output of NAND gate 274 is connected through inverter 284 to the base of transistor 285 the collector of which is connected through light emitting diode 286 to the positive source and the emitter of which is connected to ground. Light emitting diode 277 displays a ground fault condition, light emitting diode 280 displays a ground-open fault condition, light emitting diode 283 displays an open-ground fault condition and light emitting diode 286 displays an open fault condition.

OPERATION

Under normal conditions, with no fault on the McCulloh line, current flows from the positive terminal of battery 130, through diode 131, transistor 132, resistor 133, doide 134, LED 106 and over line 101 to the subscriber premises. The current then flows through the various McCulloh transmitters and over line 104 through diode 108, diode 155, transistor 156 and back to the ground terminal of the battery. Under these normal conditions, LED 106 energizes transistor 110 into conduction but, since LED 107 is not energized. transistor 111 is not conducting. Likewise, LED 108 energizes transistor 112 into conduction but, since LED 109 is not energized, transistor 113 does not conduct. Thus, one input of each NOR 180 and 200 has a high state and the other input of each has a low state such that the output of each is low. FIGS. 2B–2F show the states of all device inputs and outputs under normal conditions and with no coded signals on lines 101 and 104.

A typical McCulloh transmitter allows current to flow from its input to its output until it senses an alarm condition at which point it alternately grounds and opens the McCulloh line to place a coded message on the loop. Thus, when a McCulloh transmitter is transmitting a code to the receiver, the code takes the form of pulses on the McCulloh line. These pulses are transmitted through the current limiter and ground side to line side switch to the photo responsive transistors 110–113. Therefore, under normal conditons, the pulses are received by transistors 110 and 112 and are transmitted through the gates 180 and 200.

The pulses in the N process logic circuit are supplied to terminal 15 and then to the computer. The pulses are also supplied to terminal 3 of the inhibit circuit 117 to trigger the multivibrator 220. The pulses in the G process logic are supplied to terminal 8 of the inhibit circuit 117 but, because multivibrator 220 is also energized, these pulses are prevented from being supplied to terminal 16 which is connected to the computer. The computer then decodes and processes the McCulloh signal from the N process logic circuit.

In the N process logic circuit 114, the pulses at terminal 15 are also supplied to the −T terminal of multivibrator 183 to energize it. As long as there are pulses on the McCulloh loop, the $\overline{Q}$ output of multivibrator 183 is maintained at its low level until the pulses cease. Flip-flop 187, which is responsive to a positive going pulse, will not trigger until the $\overline{Q}$ terminal of multivibrator 183 returns to its high state. At the end of a normal transmission of a coded message, however, the output of EXCLUSIVE OR 182 retruns to a high state such that the output of EXCLUSIVE OR 190 returns to its normal low state. Since the D terminal of flip-flop 187 is low, the positive going edge of the pulse supplied to the T input of flip-flop 187 will not result in a change of its output states. The G process logic circuit operates in a similar manner. The coded signal on the loop is supplied to terminal 8 but flip-flop 213 is not switched. The pulses on terminal 8 are inhibited from being supplied to terminal 16 by inhibit circuit 117. Therefore, as described hereinbelow, the outputs are connected to the computer but do not affect fault sensing circuit 118 or sampling circuit 119 and the inhibit circuit prevents the pulses in G process logic circuit 115 from being supplied to the computer.

If a ground condition should occur at any point on the McCulloh loop, battery current flows from battery 130, through diode 131, transistor 132, resistor 133, diode 134, light emitting diode 106 and through the McCulloh line to the ground and through ground to the negative terminal of the battery 130 such that N process logic sees no change on the loop. Current will not pass through the ground fault to line 104, however, such that energization of light emitting diode 108 is terminated and a high state appears at the output of NOR 200. This causes the output of EXCLUSIVE OR 207 to go low which triggers the 3 second multivibrator 209. After 3 seconds, the outputs of multivibrators 209 return to their normal states which supplies a positive going signal to flip-flop 213.

Since the input to EXCLUSIVE OR 208 from EXCLUSIVE OR 207 is now low, the D terminal of flip-flop 213 is now high which, when flip-flop 213 receives the positive going pulse from multivibrator 209, causes the Q and $\bar{Q}$ terminals of 213 to change states. Terminal 5 becomes low which triggers fault latch 230 to provide a high state to the middle input terminal of gate 234 which energizes the transistor 236 to energize the light emitting diode 171. At the same time, terminal 4 goes high which results in the output of gate 207 returning to its normal high state and the D input of gate 213 is high. The outputs of gates 200–203, however, are non-normal. Upon energization of LED 171, transistor 159 is energized to turn on transistor 157 and turn off transistor 156. Current now flows from the battery 130 through diode 131, transistor 144, resistor 145, diode 146, light emitting diode 109, over the line 104 to the ground fault and back to the grounded terminal of battery 130. Transistor 113 is energized which returns the outputs of gates 200–203 to normal and the output of gate 207 goes low to trigger multivibrator 209 and to supply a low signal to the D terminal of flip-flop 213. Thus, when the $\bar{Q}$ terminal of multivibrator 209 returns to its high state, the Q and $\bar{Q}$ terminals of flip-flop 213 return to their normal states and G process logic 115 begins normal operation. Latch 230 has been triggered, however, such that LED 171 remains energized even through the G process logic has returned to normal.

A McCulloh receiver which begins transmitting on the line side of the ground condition supplied pulses only to the N process logic circuit 114 which transmits these pulses normally to the computer. The McCulloh transmitter which begins transmitting an alarm condition on the ground side of the ground condition supplies its pulses only through G process logic circuit 115 and inhibit circuit 117 to the computer and not through N process logic circuit 114. Therefore, terminal 3 is not supplied pulses and the inhibit circuit 117 will not inhibit the G process logic circuit pulses from being supplied to the computer. Also, the output of NAND gate 240 will not be altered and the oscillator does not begin operation to sample the fault condition.

Current is now flowing in a different direction through the line 104 but the output of gate 207 is in is normal state so that the polarity of its output is not affected by the fault on the McCulloh line.

When the ground condition is cleared, the positive terminal of the battery is connected to both lines 101 and 104 which is the eqivalent of an open circuit condition on the line. Thus, current flow in both lines 101 and 104 ceases which causes flip-flops 187 and 213 to change states. All inputs to the NAND gate 240 of the sampling circuit 119 are high which changes its output to low to change the state of oscillator enable circuit 241 to energize the oscillator. One shot circuit 250 changes state to condition NAND circuit 202 and ground storage latch 203 for restoration in case the fault has been cleared. Moreover, one shot flip-flop 245 supplies an output pulse to terminal 9 which in turn energizes transistor 156 and de-energizes transistor 157. Now current flows from the battery 130 through diode 131, transistor 132, resistor 132, resistor 133, diode 134, LED 106, line 101 to the McCulloh loop and back to line 104, through LED 108, diode 155 and transistor 156 to the ground side of the battery. Current is now established in both lines and terminal 12 becomes a high state such that the pulse from circuit 245 triggers flip-flop 244 to reset the fault latch circuit 230 to maintain the LED 171 de-energized. The resetting of the latch 230 also supplies a reset signal at terminal 13 to flip-flop 244 which resets to its normal state. Flip-flops 187 and 213 reset and NAND 240 and the oscillator enable circuit 241 return to normal and normal operation is resumed.

If the McCulloh line should become open circuited, current in both lines 101 and 104 ceases and the outputs of EXCLUSIVE OR gates 182 and 207 change states to trigger the one shot multivibrators 183 and 209 which at the end of their pulses will operate flip-flops 187 and 213. When terminals 1 and 4 become high, the output of gates 182 and 207 will resume their normal high state. Thus, any McCulloh signal coming in on either line will have its normal polarity output even though the polarity of the signals on the lines has changed. Since terminals 2 and 5 have changed states in fault sensing circuit 118, fault latch 230 is operated to again energize light emitting diode 171. Furthermore, the output of NAND gate 240 now becomes low to begin operation of the oscillator circuit. The oscillator circuit will periodically de-energize diode 171 to re-energize transitor 156. But since an open circuit continues to exist, the circuits will not change state. Particularly, the input terminal 12 of the flip-flop 244 of sampling circuit 119 is low which maintains flip-flops 244 in its normal state when it receives an input pulse from flip-flop 245.

When the fault has been cleared, the next time that LED 171 is de-energized, current will flow normally in the line to place a high signal on terminal 12 of flip-flop 244. The next triggering pulse to flip-flop 244 will cause its outputs to change states which resets fault latch 230 and oscillator enable circuit 241. Resumption of current in the lines also causes N process logic circuit and G process logic circuit 114 and 115 to resume their normal states. When current flows through the McCulloh loop again, the outputs from gates 182 and 207 assume their high states which produces a low signal at the output of gates 190 and 208 which resets flip-flops 187 and 213. Thus, the receiver resumes its normal condition.

It should also be noted that a McCulloh transmitter which begins transmitting on the ground side of the open fault will produce pulses in the G process logic circuit 115 which are connected to the computer and which are not inhibited by inhibit circuit 117 since the pulses are not also produced on the line side of the fault and, therefore, are not received by the N process logic circuit 114.

Upon the occurrence of a ground-open fault such that the line 101 is grounded and the line 104 is open circuited, current flows from the battery 130 through the circuit and through line 101, through the ground connection and back to the negative terminal of the battery. However, current will not flow in the line 104. Thus, G process logic 115 is operated such that the outputs of flip-flop 213 change state at which time the output of gate 207 will resume its normal state. Since only flip-flop 213 is changed, NAND circuit 240 of the sampling circuit 119 will not alter its state such that the oscillator will not begin operation. A McCulloh signal which occurs to the line side of the fault will be processed normally by the N process logic circuit 114 and the coded signals which arise from the ground side of the fault condition are processed by the G process logic circuit 115 and will not be inhibited since these pulses do not also occur on the line side of the loop. When the fault condition is cleared, the circuit will resume normal operation as described above.

If the open condition occurs on the line side of the McCulloh loop and a ground fault occurs on the ground side of the loop, i.e. the open-ground condition, current flow terminates in both lines 101 and 104 to de-energize transistor 156 and energize transistor 157. Therefore, under this condition, current flows in line 104 but not in line 101. However, any transmitter which begins transmitting its coded pulses will be responded to by either the N or G process logic circuit depending on which side of the fault the signal occurs.

Thus, it is clear that no matter what the polarity of the signal pulses are on the McCulloh loop or whether or not there is normal line current during the fault operation, the pulses supplied to the computer will have the same polarity since the outputs of gates 182 and 207 are maintained at the same state under both normal conditions and fault conditions. Furthermore, during normal operation the pulses flowing through G process logic circuit 115 will be inhibited from being transmitted to the computer thus establishing the priority of the pulses flowing through N process logic circuit 114. Also, the circuit automatically restores itself upon the clearance of the fault condition and utilizes for this operation an oscillating sampling circuit to periodically test the line.

In FIGS. 3, diode 277 indicates a ground condition, diode 280 indicates a ground-open condition, diode 283 indicates an open-ground condition and diode 286 indicates an open condition. If a ground condition exists on the McCulloh loop, terminals 1 and 2 maintain their normal states, terminals 4 and 5 maintain their normal states as discussed above and only terminal 18 changes. Since terminal 18 becomes high, the output of NAND circuit 271 changes to energize transistor 276 to energize light emitting diode 277. If line 101 becomes grounded and line 104 becomes open, terminals 1 and 2 maintain their normal states whereas terminals 4, 5 and 18 change states which pressure a high signal to both inputs of NAND 272 to energize LED 280. If line 101 becomes open and line 104 is grounded, terminals 1, 2 and 18 change states and terminals 4 and 5 remain normal which provides a high signal to both inputs of NAND 273 to energize LED 283. If an open condition occurs, all of the input terminals to the circuit of FIG. 3 change which presents a high signal to both input terminals of NAND circuit 274 to energize LED 286. Thus, the circuit of FIG. 3 presents a mechanism for distinguishing between the different types of fault conditions that can occur.

It is quite apparent that changes can be made in the circuit diagram as disclosed without departing from the invention and the invention is to be limited only by the claims.

The embodiments of the invention in which an exclusive property or right is claimed are defined as follows:

1. A receiver for receiving coded signals on a McCulloh loop having a line out side connected to a first terminal of a source of current and a line in side connected to a second terminal of the source at ground, said receiver for providing to a computer an output having a single polarity regardless of the polarity of said coded signals, said receiver comprising:

N process logic circuit means for receiving said coded signals on said line out side and for providing a single polarity first output regardless of the polarity of said coded signals;

G process logic circuit means for receiving said coded signals on said line in side and for providing a single polarity second output regardless of the polarity of said coded signals;

fault sensing circuit means connected to said N and G process logic circuit means for providing a third output indicative of a fault condition on said loop and for connecting said line in side from said second terminal to said first terminal of said source upon the occurrence of a fault condition; and, wherein said first, second and third outputs are supplied to a computer to provide an indication of said coded signals and said fault condition.

2. The receiver of claim 1 wherein said G process logic circuit means comprises inhibit circuit means connected to said N process logic circuit to inhibit said second output unless there is a fault condition.

3. The receiver of claim 2 wherein said N and G process logic circuit means each comprises a D flip-flop circuit having first and second outputs, a D terminal and a T terminal, one shot multivibrator having input means connected to receive said coded signals and an output connected to said T terminal, and means connected to receive said coded signals and to said second output of said corresponding D flip-flop circuit and connected to said corresponding D terminal for preventing said D flip-flop circuits from changing states except upon the occurrence of a fault condition.

4. The receiver of claim 3 wherein said input means of said N and G process logic circuit means each comprises a logic element having a first input to receive said coded signals, a second input connected to the first output of the corresponding D flip-flop circuit and an output connected to the one shot multivibrator wherein the output of said logic element is of a single polarity regardless of the polarity of said coded signals.

5. The receiver of claim 4 wherein said inhibit circuit means comprises a T monostable circuit having an input connected to said logic element output of said N process logic circuit means and an output, and a comparison gate having a first input connected to said output of said T monostable circuit, a second input connected to said logic element output of said G process logic circuit means to receive said coded signals in said G process logic circuit means and an output for supplying said second output from said G process logic circuit means only upon the existence of a fault condition.

6. The receiver of claim 2 wherein said fault sensing circuit comprises sampling circuit means for periodically sampling said loop and reconnecting said line in side to the second terminal of said source upon clearance of a fault condition.

7. The receiver of claim 6 wherein said N and G process logic circuit means each comprises D flip-flop circuit having first and second outputs, a D terminal and a T terminal, a one shot multivibrator having input means connected to said T terminal, and means connected to receive said coded signals and to said second output of said corresponding D flip-flop circuit and connected to said corresponding D terminal for preventing said D flip-flop circuits from changing states except upon the occurrence of a fault condition.

8. The receiver of claim 7 wherein said fault sensing circuit comprises a fault latch circuit having a first input connected to said second output of said N process logic circuit means D flip-flop circuit, a second input connected to said second output of said G process logic circuit means D flip-flop circuit, and output means for providing said third output and for connecting said line in side from said second terminal to said first terminal of said source upon the occurrence of a fault.

9. The receiver of claim 8 wherein said sampling circuit means comprises an oscillator enable circuit having inputs from said first outputs of both said N and G process logic circuit means D flip-flop circuits and from said output of said one shot multivibrator of said G process logic circuit means for providing an oscillator enable signal upon the occurrence of an open fault condition, an oscillator for providing periodic output signals upon receiving said oscillator enable signal, a monostable multivibrator responsive to said periodic output signals for providing an output connected to said output means of said fault latch circuit to periodically reconnect said line in said to said second terminal of said source during an open fault condition and a comparison circuit responsive to said output from said monostble multivibrator and to said line in side to maintain the reconnection of the line in side to said second terminal of said source upon clearance of said open fault condition.

10. The receiver of claim 9 wherein said input means of said N and G process logic circuit means each comprises a logic element having a first input to receive said coded signals, a second input connected to the first output of the corresponding D flip-flop circuit and an output connected to the one shot multivibrator wherein the output of said logic element is of a signal polarity regardless of the polarity of said coded signals.

11. The receiver of claim 10 wherein said inhibit circuit means comprises a T monostable circuit having an input connected to said logic element output of said N process logic circuit means and an output, and a comparison gate having a first input connected to said output of said T monostable circuit, a second input connected to said logic element output of said G process logic circuit means to receive said coded signals in said G process logic circuit means and an output for supplying said second output from said G process logic circuit means only upon the existence of a fault condition.

12. The receiver of claim 6 wherein said N and G process logic circuit means each comprises an one shot multivibrator having an input means for receiving said coded signals and an output for providing a pulse having a leading edge and a trailing edge, and first means, having first and second outputs, connected to receive said pulse from said one shot multivibrator and responsive to said trailing edge of said pulse for changing states of said first and second outputs upon the occurrence of a fault condition.

13. The receiver of claim 12 wherein said inhibit circuit means comprises a one shot multivibrator having an input connected to said N process logic circuit means and an output, and an inhibit function means having a first input connected to receive the output from said one shot multivibrator of said inhibit means and a second input for receiving said coded signals in said G process logic circuit means and an output for passing said coded signals in said G process logic circuit means upon a fault condition but not upon normal operation of said McCulloh loop.

14. The receiver of claim 13 wherein said sampling circuit comprises an oscillator enable circuit having inputs connected to the output of said one shot multivibrator of said G process logic circuit means and to said first outputs of said first means of said N and G process logic circuit means for providing an oscillator enable output upon the occurrence of an open fault condition, an oscillator means responsive to said oscillator enable output and having reconnecting means for periodically reconnecting the line in side to said second terminal of said source during an open fault condition and a comparison circuit responsive to said oscillator means and to said line in side of said McCulloh loop for maintaining the line in side connected to said second terminal of said source upon clearance of the fault condition.

15. The receiver of claim 2 wherein said inhibit circuit means comprises a one shot multivibrator having an input connected to said N process logic circuit and an output, and an inhibit function means having a first input connected to receive the output from said one shot multivibrator of said inhibit circuit means and a second input for receiving said coded signals in said G process logic circuit means and an output for passing said coded signals in said G process logic circuit means upon a fault condition but not upon normal operation of said McCulloh loop.

16. The receiver of claim 1 wherein said fault sensing circuit comprises a sampling circuit means for periodically sampling said loop during an open fault condition and reconnecting said line in side to the second terminal of said source upon clearance of a fault condition.

17. The receiver of claim 16 wherein said N and G process logic circuit means each comprises a D flip-flop circuit having first and second outputs, a D terminal and a T terminal, a one shot multivibrator having input means connected to receive said coded signals and an output connected to said T terminal, and means connected to receive said coded signals and to said second output of said corresponding D flip-flop circuit and connected to said corresponding D terminal for preventing said D flip-flop circuits from changing states except upon the occurrence of a fault condition.

18. The receiver of claim 17 wherein said input means of said N and G process logic circuit means each comprises a logic element having a first input to receive said coded signals, a second input connected to the first output of the corresponding D flip-flop circuit and an output connected to the one shot multivibrator wherein the output of said logic element is of a single polarity regardless of the polarity of said coded signals.

19. The receiver of claim 18 wherein said fault sensing circuit comprises a fault latch circuit having a first input connected to said second output of said N processs logic circuit means D flip-flop circuit, a second input connected to said second output of said G process logic circuit means D flip-flop circuit, and outut means for providing said third output and for connecting said line in side from said second terminal to said first terminal of said source upon the occurrence of a fault.

20. The receiver of claim 19 wherein said sampling circuit means comprises an oscillator enable circuit having inputs from said first outputs of both said N and G process logic circuit means D flip-flop circuits and from said output of said one shot multivibrator of said G process logic circuit means for providing an oscillator enable signal upon the occurrence of an open fault condition, an ocillator for providing periodic output signals upon receiving said oscillator enable signal, a monostable multivibrator responsive to said periodic output signals for providing an output connected to said output means of said fault latch circuit to periodically reconnect said line in side to said second terminal of said source during a fault condition and a comparison circuit responsive to said output from said monostable multivibrator and to said line in side to maintain the reconnection of the line in side to said second terminal of said source upon clearance of said fault condition.

21. The receiver of claim 16 wherein said sampling circuit comprises a oscillator enable circuit having inputs connected to said N and G process logic circuit means for providing an oscillator enable output upon the occurrence of an open fault condition, an oscillator responsive to said oscillator enable output for periodically reconnecting the line in side to said terminal of said source during an open fault condition and a comparison circuit responsive to said oscillator and to said line in said of said McCulloh loop for maintaining the line in side connected to said terminal of said battery upon clearance of the fault condition.

22. The receiver of claim 1 wherein said N and G process logic circuit means each comprises a D flip-flop circuit having first and second outputs, a D terminal and a T terminal, a one shot multivibrator having input means connected to receive said coded signals and an output connected to said T terminal, and means connected to receive said coded signals and to said second output of said corresponding D flip-flop circuit and connected to said corresponding D terminal for preventing said D flip-flop circuits from changing states except upon the occurrence of a fault condition.

23. The receiver of claim 22 wherein said fault sensing circuit comprises a fault latch circuit having a first input connected to said second output of said N process logic circuit means D flip-flop circuit, a second input connected to said second output of said G process logic circuit means D flip-flop circuit, and output means for providing said third output and for connecting said line in side from said second terminal to said first terminal of said source upon the occurrence of a fault.

24. The receiver of claim 1 wherein said N and G process logic circuit means each comprises a one shot multivibrator having an input means for receiving said coded signal and an output for providing a pulse having a leading edge and a trailing edge, and first means, having first and second outputs, connected to receive said pulse from said one shot multivibrator and responsive to the trailing edge of said pulse for changing states of the first and second outputs upon the occurrence of a fault condition.

* * * * *